United States Patent [19]

Radek

[11] 4,094,442

[45] June 13, 1978

[54] NAPKIN DISPENSER

[75] Inventor: John R. Radek, Hinsdale, Ill.

[73] Assignee: Ready Metal Manufacturing Company, Chicago, Ill.

[21] Appl. No.: 787,170

[22] Filed: Apr. 13, 1977

Related U.S. Application Data

[63] Continuation-in-part of Ser. No. 667,161, Mar. 15, 1976, abandoned.

[51] Int. Cl.[2] ..... B65H 1/26

[52] U.S. Cl. ..... 221/59

[58] Field of Search ..... 221/58, 59, 63, 45, 221/46, 52, 307, 310

[56] References Cited

U.S. PATENT DOCUMENTS

| | | | |
|---|---|---|---|
| 1,151,064 | 8/1915 | Swift | 221/63 |
| 1,792,087 | 2/1931 | Groff | 221/59 X |
| 3,840,146 | 10/1974 | Bodek | 221/45 |

*Primary Examiner*—Stanley H. Tollberg
*Attorney, Agent, or Firm*—Frank H. Marks

[57] ABSTRACT

A napkin dispenser for disposition on a restaurant table or counter and normally housing a stack of paper napkins. The dispenser is in the form of a parallelepiped with a top access opening for loading and removing napkins. Said opening is generally rectangular except for a concavely arcuate edge on one side from which napkins are normally extracted. Two opposed sides of said opening normal to the arcuate edge are provided with a pair of relatively narrow spring biased leaves resiliently extendable into the container to facilitate loading, the free edges of said leaves being longitudinally gently oblique and widening toward the aforesaid arcuate edge. Each of said leaves has a longitudinal outwardly turned lip and the exposed corners of the leaves are rounded. All of said features contribute toward convenient extraction of a napkin without damage.

5 Claims, 3 Drawing Figures

NAPKIN DISPENSER

This application is in part a continuation of my copending patent application Ser. No. 667,161, filed Mar. 15, 1976 now abandoned.

My invention relates to napkin dispensers of the type usually found on restaurant tables or counters for self service by patrons.

BACKGROUND

The standard type of such dispensers consists of a cubical sheet metal box open at the top for loading and extraction, with a spring-loaded plate therein urging the contained napkins toward the opening. Loading and withdrawal of napkins is inconvenient because of restrictions around the access opening. As the contents become more nearly exhausted, the remaining napkins become more loosely retained and freer for deliberate or inadvertent removal in quantities in excess of the actual need of the patron, with loss to the proprietor.

BRIEF OUTLINE OF INVENTION

I provide adjacent the sides of the top opening of the container relatively narrow spring biased plates or leaves hinged to the top of the container and normally approximately flush therewith and resiliently movable only inwardly of the container. Said leaves have sloping or oblique edges opposite each other, presenting a gently tapering opening that is helpful in withdrawal of napkins. Said leaves also tend to inhibit reckless withdrawal of napkins in excessive quantities.

Various other objects and advantages will appear as the description proceeds.

BRIEF DESCRIPTION OF DRAWINGS

Referring now to the drawings illustrating a preferred embodiment of my invention.

DETAILED DESCRIPTION

Figure 1:
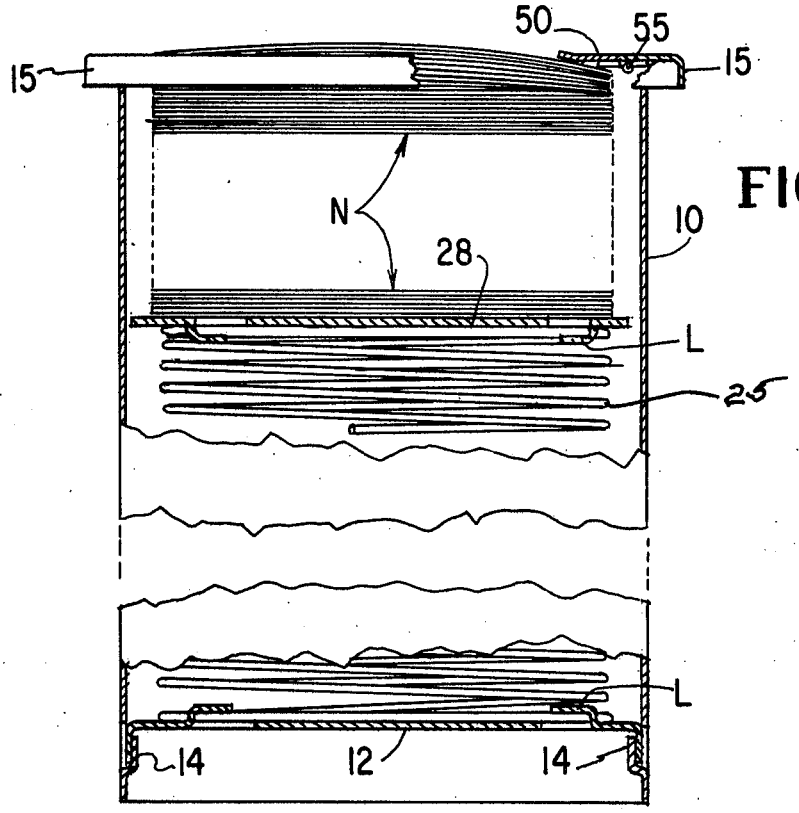
FIG. 1 is a fragmentary vertical section, partly in elevation, of a napkin dispenser embodying my invention.

My improved napkin dispenser comprises a box-like container 10 of cubical form, preferably a parallelepiped, which may be formed of sheet metal, preferably stainless steel, or other suitable material with dimensions appropriate to house a stack of paper napkins N.

The container is closed at the bottom as by a rectangular plate 12 attached to the side walls as by spot welding, brazing or screws or seated in struck-out ears 14.

The upper end of container 10 is provided with a cover plate 15 which may be flanged over for attractive finish and attached to the side walls similarly to bottom wall 12 or otherwise.

Cover plate 15 has a cut-out portion of generally rectangular shape one edge 20 of which is concavely arcuate to facilitate egress of napkins.

Disposed inside container 10 is means for urging upwardly the stack of napkins housed therein, such as the usual compression spring 25 and a follower plate 28 associated therewith. Plate 28, which is vertically slidable within container 10 and is slightly smaller than the interior dimensions thereof, has on its lower face lugs L that may be struck out of the plate for retaining an end loop of spring 25, a similar arrangement being made for securing the bottom coil of the spring.

Obviously, as napkins are stacked on plate 28 through the opening in the top, said plate will be depressed against the action of spring 25. As napkins are removed plate 28 will be urged upwardly by spring 25.

The opening in top plate 15 is partially obstructed by leaves or ears 50, 50 which are generally flush with the top plate and pivoted thereto as by concealed piano hinges 55. Said leaves are relatavely narrow and their free edges gently slope from top to bottom toward the center of the opening so as to narrow said opening adjacent arcuate edge 20. The angle of obliquity of said leaf edges is not especially critical.

Said leaf edges have a longitudinal bend, providing outwardly extending lips 60. The free corners 62 of said leaves, as seen in the broken-away parts of FIG. 2, are rounded.

The leaves 50 are normally urged to a position generally coplanar with the top plate by piano hinges 55, as seen best in FIG. 1. As seen in FIG. 3, when a stack of napkins N is loaded into the receptacle the leaves 50 will be depressed against the resilient action of their spring loaded piano hinges 55. Upon completion of loading the uppermost napkin will be depressed to free leaves 50, which will be urged upwardly by their springs to resume their normal position as in FIGS. 1 and 2.

Figure 2:
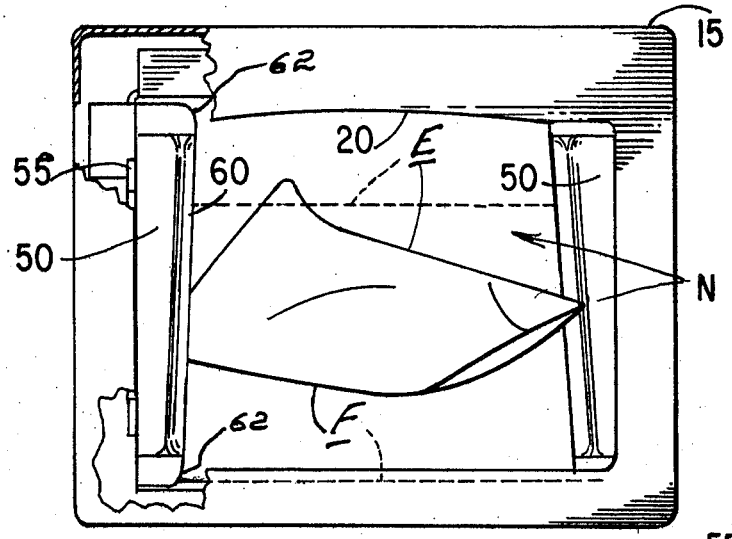
FIG. 2 is a top plan view of same, with parts broken away for added clearness.
Figure 3:
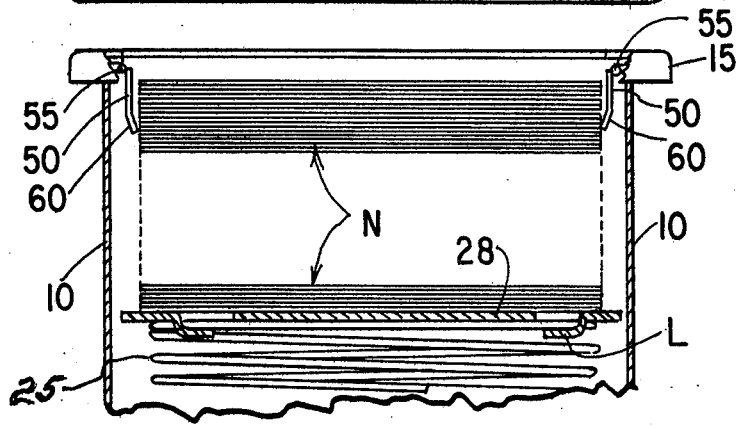
FIG. 3 is a sectional view generally similar to FIG. 1 of the upper portion of the container in napkin-loading condition.

A napkin is properly extracted, as seen in FIG. 2, by grasping the exposed edge E thereof and pulling it away from top plate 15. Fold F normally underlying the bottom portion of top plate 15 will be drawn out and, as outward force is applied to the napkin in a direction away from the dispenser, the napkin will progressively become free along its side edges adjacent leaves 50 until, finally, its upper edge adjacent arcuate edge 20 and normally underlying the top portion of plate 15 will be freed, without damage to the napkin. The napkins being all similarly positioned in the stack, they will successively be extracted in similar manner.

CONCLUSION

Various changes and other embodiments coming within the spirit of my invention may suggest themselves to those skilled in the art. Hence, I do not wish to be limited to the specific forms shown or uses mentioned except to the extent indicated in the appended claims.

I claim:

1. A napkin dispenser for a stack of folded napkins each folded in multiple plies having a final rectangular contour, with the outermost lifting ply terminating in a straight edge extending across the width of the folded napkin along a line parallel to the top and bottom edges thereof, comprising (a) a parallelepiped container having a rectangular end wall of the approximate dimensions of said folded napkins and four side walls fixed thereto, (b) an ingress-egress wall secured to the sidewalls opposite said end wall and having a generally rectangular opening therein for leading and dispensing napkins into and out of the container, (c) a spring loaded follower within the container normally urging napkins within said container toward said opening, (d) a pair of relatively narrow leaves having a longitudinal edge hingedly mounted on opposite sides of said opening and spring biased normally to assume a horizontal position generally coplanar with said opening and resiliently rotatable into said container when napkins are inserted through the opening against the follower, with the lifting ply straight edge perpendicular to the sides of the opening and the leaves completely covering the side edges of the napkins, (e) said leaves also having free longitudinal edges opposite their hinged edges gently sloping substantially from end to end of said leaves, so as to present an opening of tapering width for convenient egress of a napkin, whereby a napkin may be withdrawn from said stack of folded napkins within the dispenser by grasping the free edge of the outermost ply extending transversely of said opening and pulling it away from said opening.

2. A dispenser as in claim 1, wherein said opening has a concavely arcuate edge extending transversely of said leaves and adjacent the wider ends thereof.

3. A dispenser as in claim 2, wherein the free longitudinal edges of said leaves have outwardly extending lips to facilitate napkin withdrawal.

4. A dispenser as in claim 1, wherein said leaves have outwardly extending marginal lips.

5. A dispenser as in claim 4, wherein the opening has a concavely arcuate edge extending transversely of said leaves.

* * * * *

UNITED STATES PATENT AND TRADEMARK OFFICE

CERTIFICATE OF CORRECTION

PATENT NO. : 4,094,442

DATED : June 13, 1978

INVENTOR(S) : John R. Radek

It is certified that error appears in the above-identified patent and that said Letters Patent are hereby corrected as shown below:

Column 2, line 64, "leading" should read -- loading --.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*